US006398237B1

(12) United States Patent
Attey

(10) Patent No.: US 6,398,237 B1
(45) Date of Patent: Jun. 4, 2002

(54) SKATEBOARD

(75) Inventor: Graeme Scott Attey, South Fremantle (AU)

(73) Assignee: Design Science Pty.Ltd., South Fremantle (AU)

( * ) Notice: Subject to any disclaimer, the term of this patent is extended or adjusted under 35 U.S.C. 154(b) by 0 days.

(21) Appl. No.: 09/582,357

(22) PCT Filed: Dec. 30, 1998

(86) PCT No.: PCT/AU98/01007

§ 371 (c)(1),
(2), (4) Date: Jun. 22, 2000

(87) PCT Pub. No.: WO99/34886

PCT Pub. Date: Jul. 15, 1999

(30) Foreign Application Priority Data

Dec. 30, 1997 (AU) ..... PP1167
Apr. 20, 1998 (AU) ..... PP3030

(51) Int. Cl.[7] ..... A63C 17/01
(52) U.S. Cl. ..... 280/87.042; 188/29; 280/11.221
(58) Field of Search ..... 280/87.041, 87.042, 280/11.221, 11.233, 11.25; 188/29, 57, 24.18

(56) References Cited

U.S. PATENT DOCUMENTS

| | | | | | |
|---|---|---|---|---|---|
| 3,385,608 | A | * | 5/1968 | Waddell | 280/11.2 |
| 3,876,217 | A | * | 4/1975 | Copier | 280/11.23 |
| 4,037,852 | A | * | 7/1977 | Bayer et al. | 280/87.04 |
| 4,127,282 | A | * | 11/1978 | Gorlach et al. | 280/87.04 |
| 4,181,316 | A | * | 1/1980 | Brand et al. | 280/11.2 |
| 4,991,861 | A | | 2/1991 | Carn et al. | 280/87.042 |
| 5,160,155 | A | * | 11/1992 | Barachet | 280/87.042 |
| 5,544,919 | A | * | 8/1996 | Tinkler | 280/809 |
| 5,860,657 | A | * | 1/1999 | Kroher | 280/11.22 |
| 5,975,229 | A | * | 11/1999 | Hosoda | 180/181 |

FOREIGN PATENT DOCUMENTS

| | | |
|---|---|---|
| AU | B-37668/95 | 10/1995 |
| DE | 451163 | 9/1927 |

* cited by examiner

*Primary Examiner*—Brian L. Johnson
*Assistant Examiner*—Tony Winner
(74) *Attorney, Agent, or Firm*—Duane Morris LLP.

(57) ABSTRACT

An in-line skateboard (10) includes a frame (18) located between-aligned wheels (14, 16). The frame (18) is pivotally connected at (32) to a leading wheel (14) by means of a fork member (30) which extends from an axle (15) of the wheel (14). The pivotal connection (32) is disposed below the level of the axle (15).

21 Claims, 5 Drawing Sheets

SKATEBOARD

BRIEF DESCRIPTION OF THE INVENTION

The present invention relates to a skateboard.

FIELD OF THE INVENTION

In conventional skateboards, a total of four wheels are arranged with one pair at the front and one at the back. All wheels are of very small diameter so as to fit under the deck with each pair possessing a single axle mounted on an oblique pivot, providing steering via the inside wheels moving in toward each other when the rider shifts weight onto that side, and the outside wheels moving away from each other on the unweighted side of the board. Steering is thus provided by all four wheels at once.

The pitfalls of conventional skateboard design are that the small wheels are extremely sensitive to surface irregularities, making them impractical and dangerous to use on anything other than very smooth surfaces. Attempts have been made to overcome such problems by making skateboards with larger wheels. However, larger wheels result in either a higher deck (creating instability) or a much wider structure (with the larger wheels extended out past the edge of the deck) which makes the board too cumbersome and sluggish. The traditional skateboard layout has therefore been restricted to relatively smooth surfaces since its inception.

In an attempt to try and break away from traditional skateboard limitations, new designs have been proposed. One such design was by Barachet, who proposed a two wheeled skateboard with both wheels aligned along a central axis (in-line), like a scooter The design included a self-steering front wheel, fixed rear wheel and twopart deck, the first part for the front foot between the two wheels and the second part for the rear foot behind the rear wheel.

Barachet's design included a front wheel held by a fork with a pivot point forward of the middle of the front wheel. By leaning to one side of the board, a front pivot allows the front wheel to turn in the appropriate direction, steering the board. It has been found that while the front wheel does turn, these devices are extremely unstable and very difficult to ride.

It has now been discovered that the reason for this instability is that the front wheel fork pivot point is higher than the axle of the wheel. This means the rider's weight is being applied above the mid point of the wheel, resulting in great instability and essentially making the device impractical and consequently, uncommercial. Further, it has been discovered that because the pivot point is above the front wheel axle, the arc that the wheel swings through when it turns is concave in relationship to the ground. This has the very significant undesirable effect of wanting to turn the wheel to the outside extremities when a rider's weight is applied to the board.

A variation of Barachet's design is found in the German Grassboards developed by Kroher. Kroher has made only two changes to Barachet's design, these being that the front wheel pivot point is horizontally in line with the axle and the single rear wheel is replaced by two wheels side by side, a small distance apart. It is readily apparent that the dual rear wheels have replaced the single wheel to try and provide some stability to the board in an attempt to make it easier to ride. However, in requiring the lateral stability provided by the dual rear wheels, the smooth transitional side to side turning characteristic theoretically offered by an in-line two-wheeled board is lost.

The present invention seeks to alleviate some, if not all, of the aforementioned problems.

SUMMARY OF THE INVENTION

In accordance with one aspect of the present invention there is provided an in line skateboard including a longitudinally extending frame locating aligned wheels, the wheels being mounted on axles, and one of the wheels being a forwardmost steering wheel, characterised in that the frame is pivotally connected to the forwardmost steering wheel at a location below and in front of the axle of that wheel.

Preferably, a fork member is connected to the axle of the forwardmost steering wheel, and an end of the frame is pivotally connected to the fork member at a location below the axle of the or each wheel.

More preferably, a leading end of the frame is pivotally connected to a leading end of the fork member at a location forward of and below the axle of the forwardmost steering wheel.

It has been found that making the front fork pivot point lower than the forwardmost steering wheel axle (as well as in front of the axle) actually provides stability as a result of a convex arc created by the forwardmost steering wheel as it swings through its turning angle. It has been found that the application of a rider's weight therefore automatically centres and straightens the forwardmost steering wheel, creating stability and control.

Preferably, the pivot point is not made so low that it will hit the ground in rough areas. It is generally kept as low as practicable without creating undue clearance problems. However, the further the pivot point is raised up from the ground, the less stable and controllable the skateboard of the present invention becomes. Therefore, there is a tradeoff between stability and ground clearance. It has generally been found that the fork member may preferably be disposed at an angle in the range from 10–45 degrees, preferably to 20–25 degrees, from the horizontal. The fork member angle itself is an imaginary line drawn from the wheel axle down to the ground via the exact centre of the pivot of the fork. The pivot arc angle is perpendicular to this and is an imaginary line drawn along the axis of the pivot.

It has also been found in the present invention that the use of relatively large wheel sizes such as of at least 300 mm in diameter, increases the stability of the system. In practice it has been found that the preferred wheel diameters are typically in the 400–600 mm range.

The stability provided by the skateboard of the present invention is such that wheel alignment springs or returns are not necessary to assist in riding. Even if the front wheel swings off centre when performing jumps and the like (when no rider weight is applied to the board), as soon as weight is reapplied, the front wheel is automatically straightened and stabilised. Further, it has been found that the fork member, in conjunction with the wheel connected to it should be able to turn very freely.

It is therefore preferential to use one or more good quality sealed roller bearings in the pivot mechanism to ensure that the pivot is always free to turn. Sealed deep groove bearings offer a good example of a suitable type as they are designed to withstand high load from several directions as well as preventing dirt from entering.

It has also been found that rather than using a straight sided frame with a flat deck, it may be preferable to curve the frame out most towards the front (to allow for sufficient front wheel tuning), in towards the middle (which may be the lowest area closest to the ground) and out again slightly towards the rear to provide adequate width for a rear foot position. Further, the widest points are typically the highest points to provide sufficient ground clearance during turns and the narrowest points can be the closest to the ground. This type of complex 3D curve also provides a structurally superior frame, as well as a more aesthetically pleasing one.

As an alternative, it is possible to have a single frame tube extending up from the pivot and around, directly over the adjacent wheel, and back down to a reasonable ground height for the deck, extending rearwards to where it may split into two sections to support the rear wheel.

As another accessory, a brake may be incorporated, mounted in typical scooter fashion with brake pads and actuators acting on the rear wheel. However, it is envisaged that the rider could hold a brake lever in one hand, the brake lever being flexibly attached to brake pads via a cable. This way riders can still stand with a surfing/snowboarding style stance while being able to freely move their hand holding the brake lever because of the flexible cable. This has the added benefits of being able to prevent the skateboard of the present invention from running away when unattended, as well as allowing a rider to deliberately skid the rear wheel under hard braking and go straight down steep hills with speed control from light to moderate braking.

Two other alternatives are available for preventing a skateboard of the present invention from running away down a hill after stepping off. The first is a wrist strap similar to that used by boogie-boarders in the surf. This consists of a coiled length of elastomeric cord with "Velcro" attachments at each end (one for the wrist and the other for the frame of the skateboard).

The other alternative is a more purpose built rear foot activated brake. In this instance, there may be provided a spring biased button rising up through the deck where the rear foot is positioned. Under the spring biased button there may be a plate with a bottom section attached to the button and an upper section touching the rear wheel. Without rear foot pressure being applied to the button (when not being ridden) the upper section may maintain pressure on the rear wheel. As soon as a rider's rear foot is positioned on the rear of the deck (and over the button) the upper section of the plate releases its pressure from the wheel. This means the rear wheel is free to turn as soon as a riders rear foot is in position on the board but as soon as the rider steps off, the brake is automatically applied and the skateboard stops.

This brake design also may be used as a progressive brake while riding simply by angling the rear foot slightly to allow the button to rise up slightly under the foot to apply the required degree of braking power.

A further accessory which may be used is a form of foot strap to provide a more snug fit for the feet while riding a skateboard according to the present invention. The foot strap may be formed of angled, flexible plates that extend up from the frame and back for the front foot and forward for the rear foot. Riders simply turn their feet around slightly to slide under the foot straps and rotate their feet back to release. This system is designed for ease of use without the difficulty of trying to slide in and out of conventional foot straps and the resulting dangers created by slow release.

However, advanced riders could prefer to use conventional foot-straps of the type used by sailboards for extra foot security when performing manoeuvres such as jumps.

Also, the skateboard of the present invention could be provided with a detachable set of handlebars. For example, by incorporating a quick-detach fitting at the front wheel axle or adjacent the fork member pivot point, scooter type handlebars may be fitted onto the skateboard. With handlebars attached, the skateboard acts as a scooter so that a rider can scoot along to a venue, then detach the handlebars and ride the skateboard down hills before re-attaching the handlebars to return home. The skateboard of the present invention may also be used in conjunction with kites.

By holding onto a handle attached to an end of a kite string a skateboard may become mobile via the power of the wind, enabling gybing and tacking type manoeuvres to be achieved.

Further, the skateboard of the present invention is well suited to being powered by motors via the non-steering wheel, Small petrol and electric motors can be used to drive the skateboard forward on flat surfaces or even power it back up hills after rolling down without power. Electric motors are convenient for this as the motor can be recharged on the run down the hill and then switched on to drive the board back up the hill to minimize overall battery drain.

It is envisaged that the skateboard of the present invention may operate on surface conditions ranging from smooth asphalt/bitumen to grass and dirt such as local parks, car parks and open sloping fields.

Just as the front wheel of the skateboard of the present invention may be selfsteering, in another aspect of the present invention, the rear wheel may also pivot in similar manner to the front wheel should a tighter turning radius be required. Also, it is envisaged that the front wheel could be fixed with the rear wheel pivoting as another alternative.

The present invention will now be described, by way of example, with reference to the accompanying drawings, in which:

DESCRIPTION OF THE INVENTION

Figure 1:
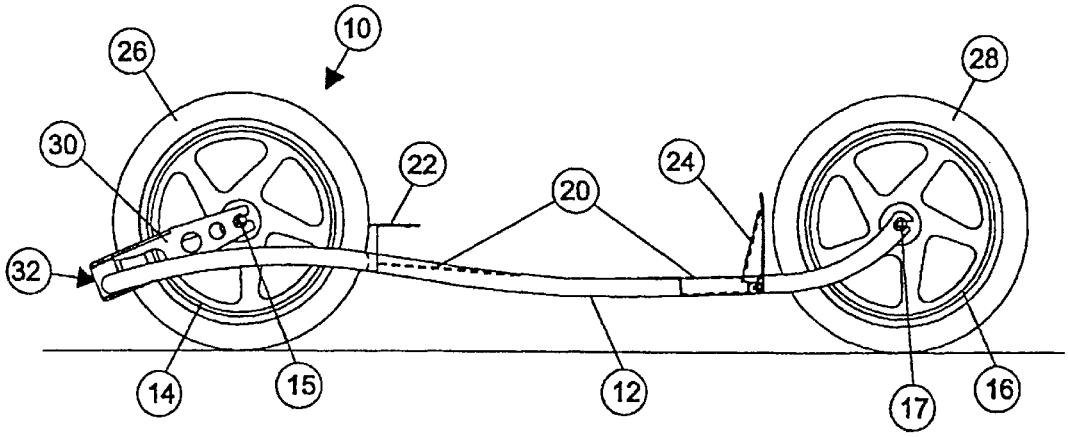
FIG. 1 is a side elevation of a skateboard in accordance with the present invention.

In FIGS. 1 to 4 of the accompanying drawings, there is shown a skateboard 10 in accordance with the present invention including a frame 12, a leading wheel 14 and a trailing wheel 16. The wheel 14 is mounted for axial rotation on an axle 15 whilst the wheel 16 is mounted for axial rotation on an axle 17. Further, as will be described the leading wheel 14 is arranged for lateral pivotal movement whilst the trailing wheel 16 is laterally fixed.

Figure 2:
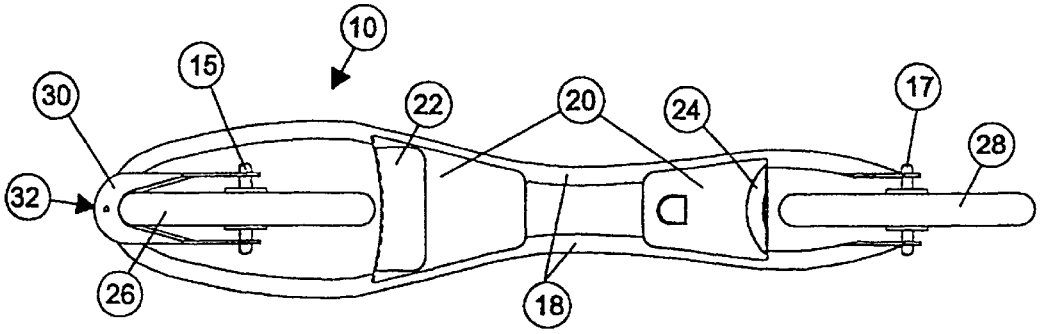
FIG. 2 is a plan view of the skateboard of FIG. 1.

The frame 12 includes a pair of spaced longitudinally extending frame members 18 extending from front to back of the skateboard 10. Each frame member 18 includes an outwardly curved leading portion adjacent the wheel 14 as seen in FIG. 2, a mid-portion in which the frame members 18 curve inwardly so as to be relatively close together, and a rear portion adjacent the wheel 16 in which the frame members are curved outwardly. As seen in FIG. 1, the frame members 18 curve longitudinally upwardly to a point adjacent the mid point of the wheel 14 and then curve downwardly towards the middle of the frame 12 and then curve upwardly to the axle 17 of the wheel 1.6. The widened portion adjacent the front wheel 14 enables the wheel 14 to pivot through a substantial angle. The widened position adjacent the rear wheel 16 enables the rear portion of a deck 20 to be wide enough to accommodate a foot comfortably. It can also be seen that the wider frame portions have relatively high ground clearance compared to the mid region of the frame.

A two part deck 20 is mounted across the frame members 18. The leading part of the deck 20 is a flat member having a front "L"-shaped toe-jam foot support 22 mounted thereon. The rear part of the deck 20 is in the form of a flat plate having a rear upwardly extending foot stop 24.

The wheel 14 is provided with a tyre 26 whilst the wheel 16 is provided with a tyre 28.

As can be seen in FIG. 1 the frame members 18 extend forwardly beyond the axle 15 and are disposed below the level of the axle 15 adjacent the wheel 14. As shown the frame members 18 are connected to the wheel 14 by means of a fork member 30 which extends around the front of the wheel 14 and extends rearwardly to the axle 15. The fork member 30 is fixedly connected to the axle 15 and is also pivotally connected by means of a pivot at 32 to the frame members 18 at their leading ends. The pivotal connection point is, as can be seen in FIG. 1, below the level of the axle 15 and also below the level of the axle 17.

Figure 3:
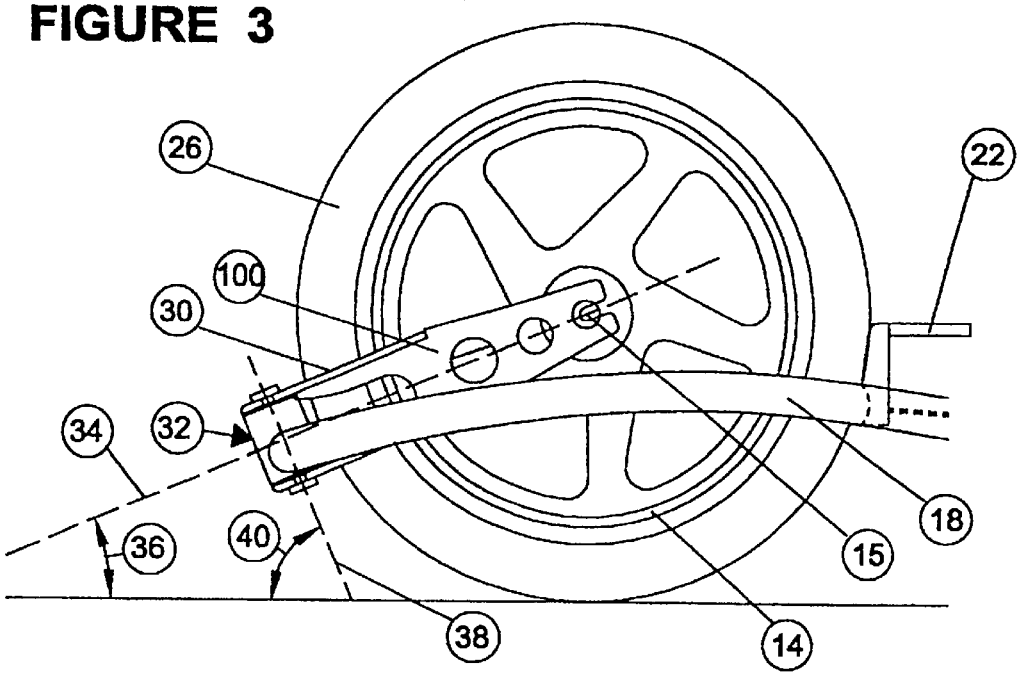
FIG. 3 is a side elevation of a front wheel of the skateboard of FIG. 1 in enlarged scale.

As can be seen in FIG. 3, a line 34 from the axle 15 through the midpoint of the pivot 32 subtends an angle 36 with the ground. The angle 36 is the fork member angle discussed hereinabove. Further, a line 38 passes through the pivot 32 at right angles with the line 34 and subtends an angle 40 with the ground. The angle 40 is the pivot arc angle discussed hereinabove.

Figure 4:
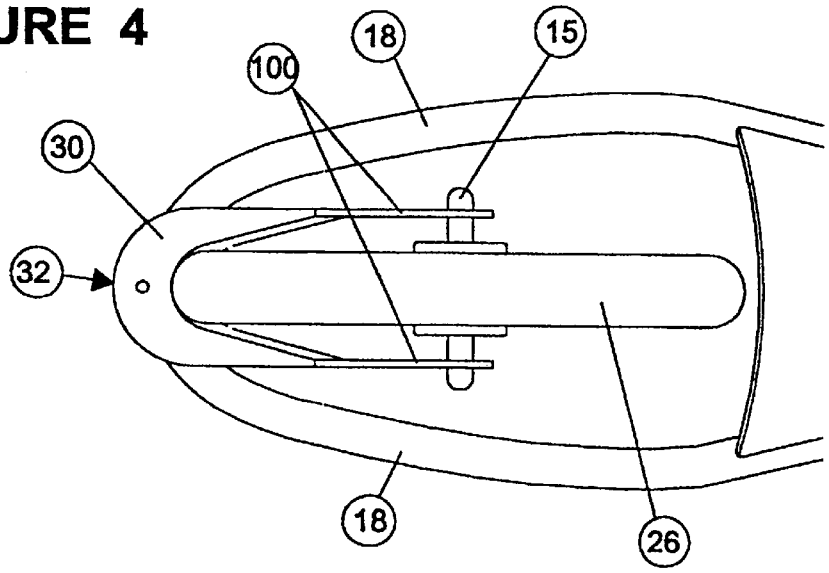
FIG. 4 is a plan view of the front wheel of FIG. 3.

Referring to FIG. 4 the fork 30 and the wheel 14, including the tyre 26, are free to swing backwards and forwards via the pivot 32, between the frame members 18. The swingarm fork assembly 30 has appropriately shaped side plates 100 which act as stops against the frame members 18 to prevent the wheel 14 from swinging too far and contacting the tyre 26 against the frame members 18.

Figure 5:
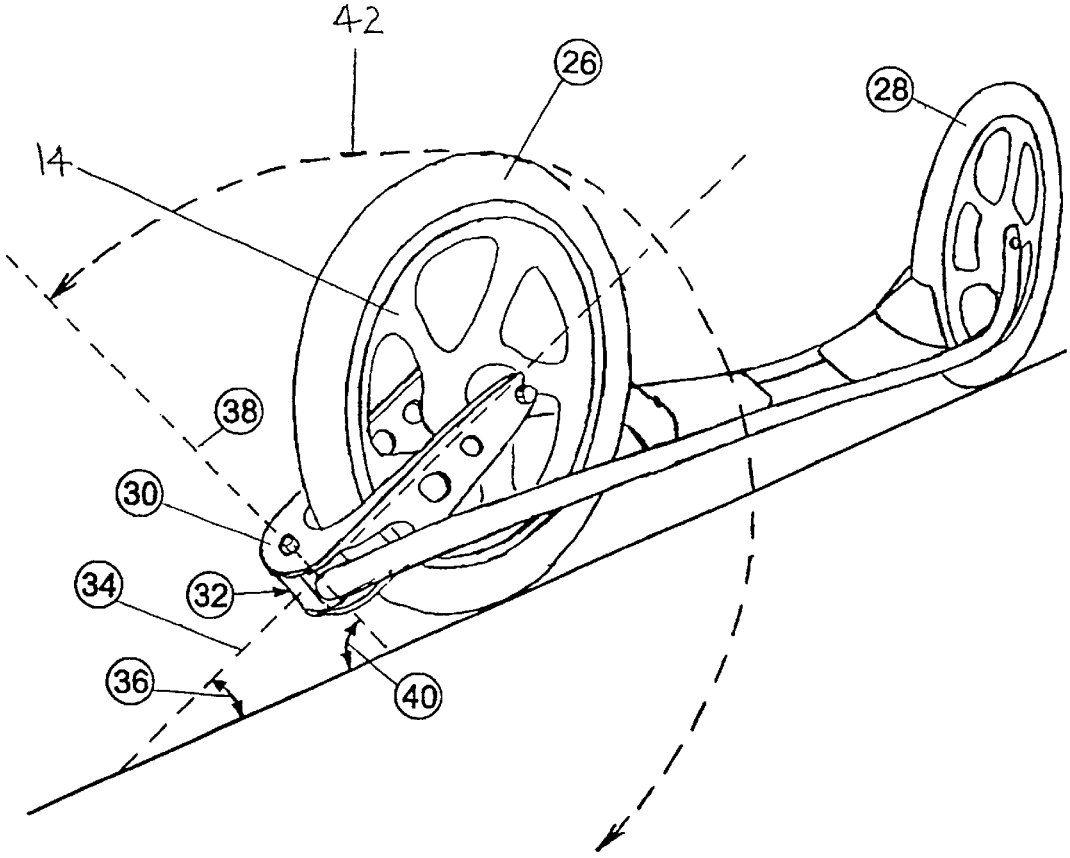
FIG. 5 is a perspective view of the skateboard of FIGS. 1 to 4 showing the convex arc of the front wheel as it sweeps through its turning range.

In FIG. 5 there is shown the front wheel 14 and the convex curve 42 through which the front wheel 14 moves.

If the centre of the pivot 32 were at axle height with the pivot arc angle 40 at 90 degrees to the ground (vertical) then the wheel itself would effectively sweep around, horizontally, drawing an imaginary large 3D donut.

Now, if the centre of the pivot 32 is below axle height as in the present invention with the pivot arc angle 40 at say 45 degrees to the ground then the wheel itself effectively sweeps around, drawing an imaginary large 3D donut on a 45 degree tilt in this example. The highest point of the donut is found midway between the frame members 18. Consequently, if weight is applied down onto the pivot 32 (i.e. rider stands on board) then the swingarm fork 30 immediately centres itself to the highest point of the donut (the top of the convex curve 42).

Figure 6:
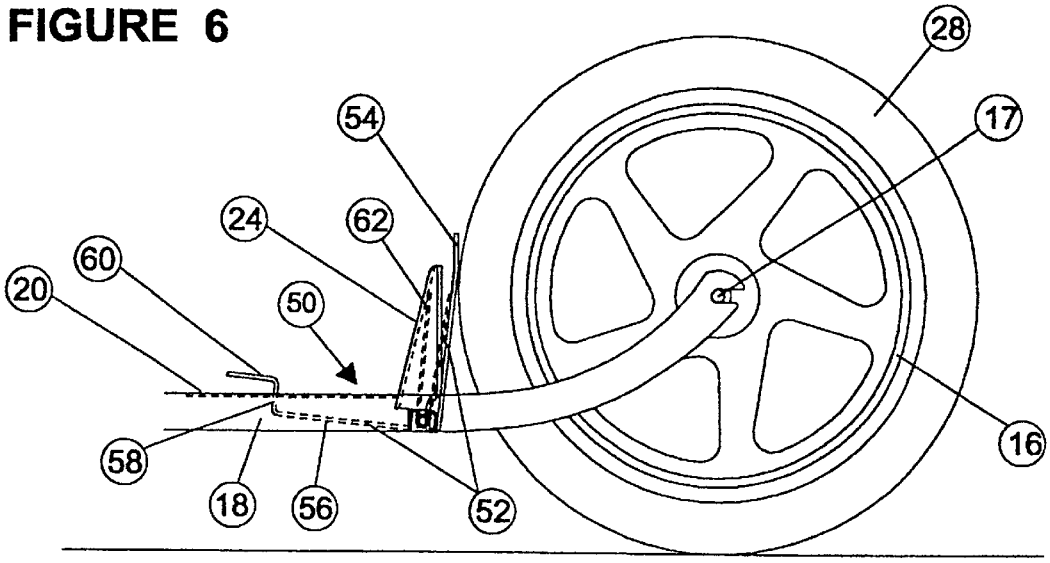
FIG. 6 is a side elevation of a rear wheel of the skateboard of FIG. 1 to an enlarged scale showing a brake in an operational condition.
Figure 7:
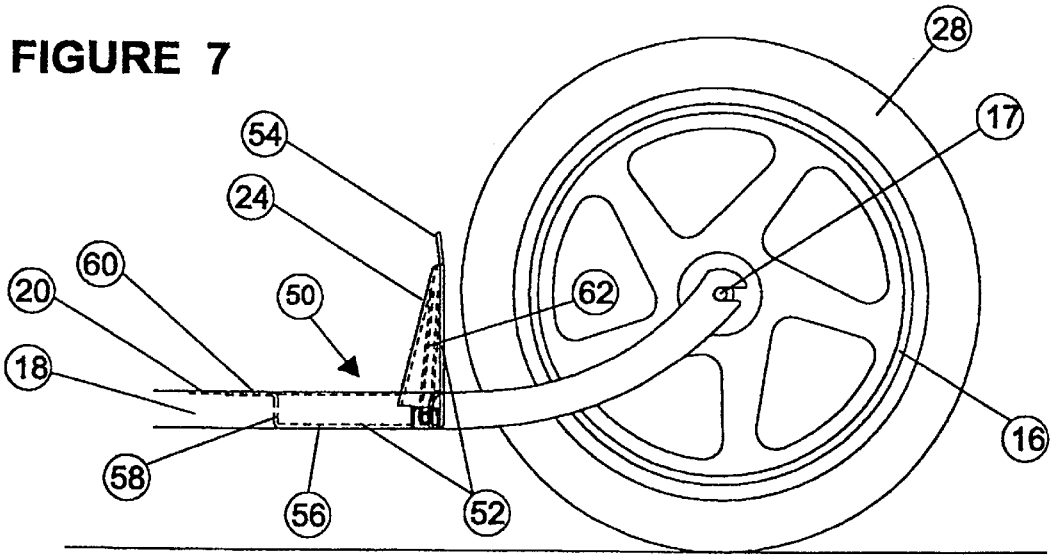
FIG. 7 is a view similar to FIG. 6 showing the brake in a non-operational condition.
Figure 8:
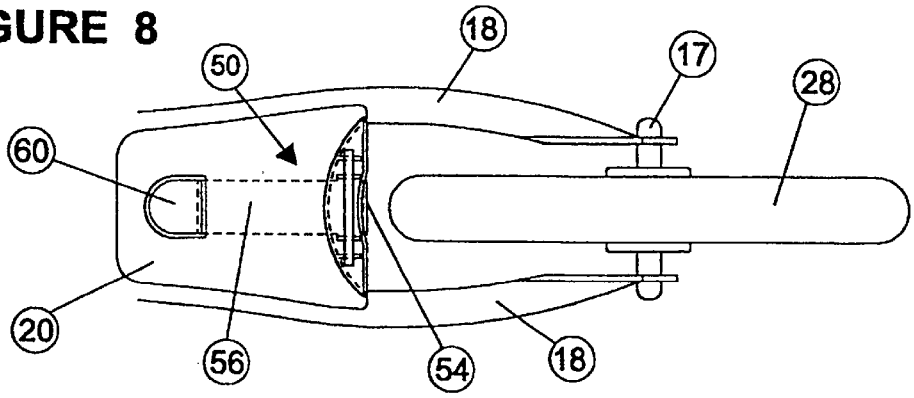
FIG. 8 is a plan view of the rear wheel of FIG. 7.

In FIGS. 6 to 8, there can be seen more clearly one embodiment of a brake mechanism 50 for the skateboard 10 of the present invention.

As can be seen in FIG. 6, the brake mechanism 50 comprises an "L"-shaped member 52 which is normally spring biased by means of a spring 62 so that an upwardly extending braking member 54 bears against the periphery of the tyre 28 of the rear wheel 16. Further, the member 52 has a generally horizontal lower member 56 disposed below the rear part of the deck 20. The lower member 56 has an upwardly extending leading portion 58 which projects through an aperture in the deck 20 and is connected to a generally horizontal button portion 60. When a rider has a foot on the rear portion of the deck 20 the foot depresses the button portion 60 which pivots the portion 56 and the member 58 downwardly. This causes the braking member 54 to disengage from the periphery of the tyre 28 of the wheel 16 as shown in FIGS. 7 and 8.

When the rider removes his foot from the rear portion of the deck 20 the "L"-shaped member 52 reverts to the position shown in FIG. 6 and braking force is therefore applied to the wheel 16.

Figure 9:
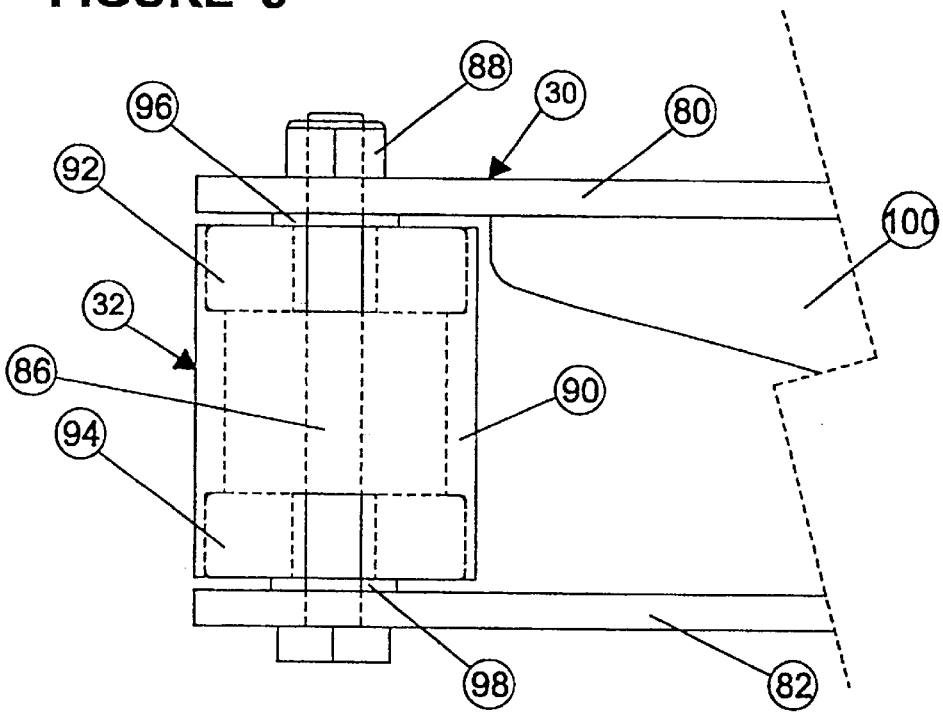
FIG. 9 is a side elevation of an embodiment of a fork pivot which may be used in the skateboard of the present invention.
Figure 10:
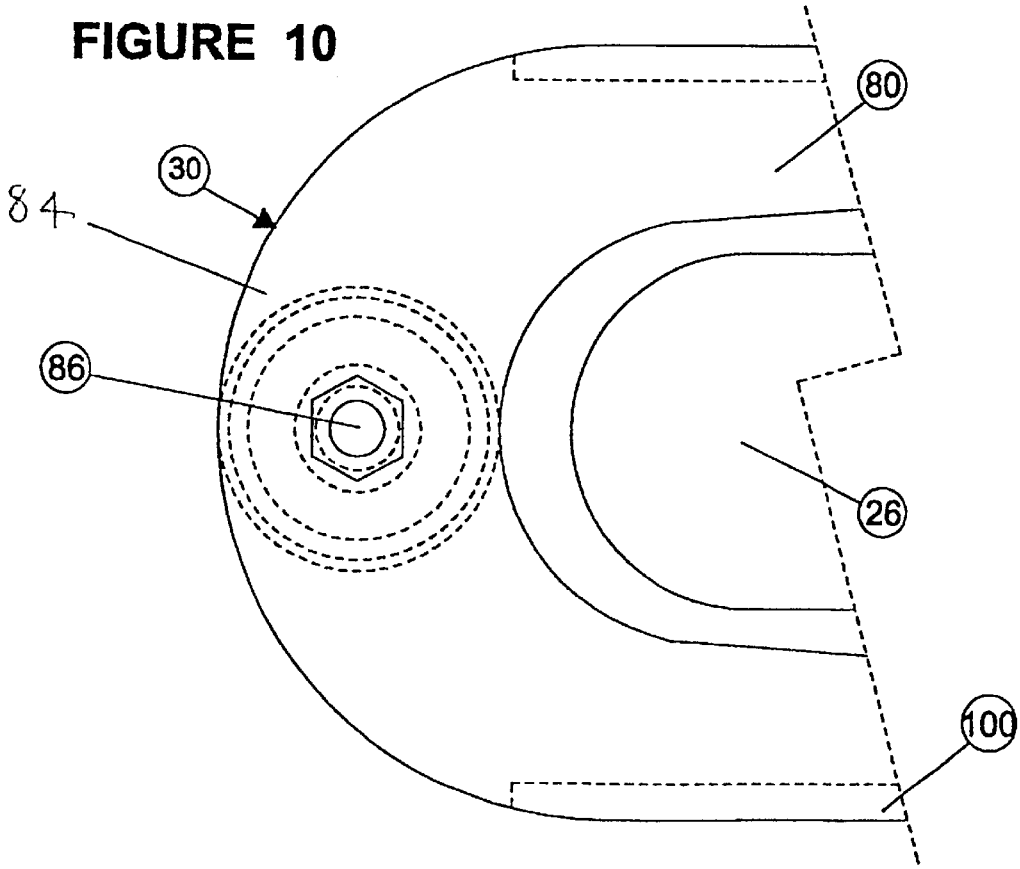
FIG. 10 is a plan view of the fork pivot of FIG. 9.

In FIGS. 9 and 10 there is shown a mounting arrangement for the swing arm fork member 30 to the pivot 32. As can be seen in FIG. 9, the fork member 30 may include a top plate 80 and a parallel base plate 82.

As can be seen in FIG. 10, the plates 80 and 82 extend through an arc 84 in front of the wheel 14.

The plates 80 and 82 are both fixedly connected via side plates 100 and the fork assembly interconnected by a bolt 86 which passes through aligned apertures in the plates 80 and 82 and is threadedly engaged with a nut 88 to retain it in place. Surrounding the bolt 86 between the plates 80 and 82 is a bearing housing 90 fixedly connected to the front of each frame member 18 and containing an upper roller bearing 92 and a lower roller bearing 94. A flanged connection bush 96 fits into the bearing 92, whilst a flanged connection bush 98 fits into the bearing 94. The bushes 96 and 98 are contiguous with the bolt 86 and the plates 80 and 82.

With the arrangement shown in FIGS. 9 and 10, the bolt 86, the plates 80 and 82 and the bushes 96 and 98 are able to rotate axially relative to the bearing housing 90 and the frame since they are free to rotate by means of the roller bearings 92 and 94. In use, the board 10 is ridden by a rider placing his or her feet on the deck 20, the front wheel and the back foot on the deck nearest the rear wheel, probably against the rear foot support 24. Further, the button 60 is depressed by the rear foot to disengage the brake mechanism 50.

The skateboard 10 can then be ridden, particularly downhill, on a wide variety of surfaces including smooth tarmac or concrete but also over uneven ground such as grassed surfaces.

The arrangement of the fork member 30 being connected to the frame 18 below the level of the axle 15 ensures that the leading wheel 14 self-centers whilst the skateboard 10 is being ridden in an upright manner and only cants to one side or the other when the rider induces a lean in the skateboard 10 to cause it to travel along a curved path. Thus, the direction of travel of the skateboard 10 is controlled automatically by rider weight shift without the need for separate steering mechanism or devices such as handlebars to control pivotal movement of the leading wheel 14. Modification and variations such as would be apparent to a skilled addressee are deemed within the scope of the present invention. For example, whilst the two wheeled skateboard embodiment is preferred it is envisaged that the skateboard could have more than two wheels. For example, instead of a single wheel at the rear, there can be pair of wheels mounted on a single axle or axis.

What is claimed is:

1. An in line skateboard including a longitudinally extending frame locating aligned wheels, the wheels being mounted on axles, and one of the wheels being a forward-most steering wheel, wherein the frame is pivotally connected to the forward-most steering wheel by a pivot located entirely below and in front of the axle of the forward-most steering wheel, the pivot being disposed relative to a ground surface at a leading acute angle which subtends between the inclination of the pivot and the ground surface, such that when a rider is mounted on the skateboard the weight of the rider stabilizes the forward most steering wheel of the skateboard.

2. An inline skateboard according to claim 1 comprising two wheels mounted on respective axles.

3. A skateboard according to claim 2 where one of said two wheels trails the other of said two wheels wherein said trailing wheel is non-pivotally connected to the frame.

4. A skateboard according to claim 3 wherein the frame includes two longitudinal members which are relatively widely spaced adjacent the forward-most steering wheel to permit transverse pivotal movement of the forward-most steering wheel.

5. A skateboard according to claim 4 wherein a deck is supported by the longitudinal members to provide a mounting for the feet of a rider.

6. A skateboard according to claim 3 wherein the forwardmost steering wheel is connected to the frame by a fork member.

7. A skateboard according to claim 6 wherein the frame includes two longitudinal members which are relatively widely spaced adjacent the forward-most steering wheel to permit transverse pivotal movement of the forward-most steering wheel.

8. A skateboard according to claim 6 wherein the fork member is disposed at an angle in the range from 10 to 45 degrees from the horizontal.

9. A skateboard according to claim 8 wherein the frame includes two longitudinal members which are relatively widely spaced adjacent the forward-most steering wheel to permit transverse pivotal movement of the forward-most steering wheel.

10. A skateboard according to claim 8 wherein the fork member is dispensed at an angle in the range from 20 to 25 degrees from the horizontal.

11. A skateboard according to claim 10 wherein the frame includes two longitudinal members which are relatively widely spaced adjacent the forward-most steering wheel to permit transverse pivotal movement of the forward-most steering wheel.

12. A skateboard according to claim 6 wherein the fork member is fixedly connected to the axle of the forward-most steering wheel and extends forwardly to a pivotal connection with the frame.

13. A skateboard according to claim 12 wherein the fork member is disposed at an angle in the range from 10 to 45 degrees from the horizontal.

14. A skateboard according to claim 12 wherein the frame includes two longitudinal members which are relatively widely spaced adjacent the forward-most steering wheel to permit transverse pivotal movement of the forward-most steering wheel.

15. A skateboard according to claim 12 wherein the fork member is connected to the axle on opposite sides of the forward-most steering wheel and extends forwardly on both sides of the forward-most steering wheel and has a bridging portion extending around a front portion of the forward-most steering wheel, the bridging portion containing the pivotal connection to the frame.

16. A skateboard according to claim 15 wherein the fork member is disposed at an angle in the range from 10 to 45 degrees from the horizontal.

17. A skateboard according to claim 15 wherein the frame includes two longitudinal members which are relatively widely spaced adjacent the forward-most steering wheel to permit transverse pivotal movement of the forward-most steering wheel.

18. A skateboard according to claim 1 wherein means for braking are provide to prevent rotation of one or more of the wheels when a rider steps off or falls from the skateboard.

19. A skateboard according to claim 18 wherein the means for braking include a member arranged to bear against a wheel when a rider is not on the skateboard, but to be moved away from the wheel under pressure from a riders foot when a rider is on the skateboard.

20. A skateboard according to claim 1 wherein each wheel has a diameter of at least 300 mm.

21. A skateboard according to claim 20 wherein each wheel has a diameter in the range from 400 to 600 mm.

* * * * *